US006698739B1

(12) United States Patent
McKim

(10) Patent No.: US 6,698,739 B1
(45) Date of Patent: Mar. 2, 2004

(54) APPARATUS FOR RETAINING OBJECTS ON A SURFACE AND RELATED METHODS

(76) Inventor: Mark D. McKim, 26565 Via Manolete, Mission Viejo, CA (US) 92691

( * ) Notice: Subject to any disclaimer, the term of this patent is extended or adjusted under 35 U.S.C. 154(b) by 178 days.

(21) Appl. No.: 09/988,843

(22) Filed: Nov. 19, 2001

(51) Int. Cl.[7] ..... B25B 1/08; B25B 5/08

(52) U.S. Cl. ..... 269/234; 269/238; 269/310; 269/32; 269/94

(58) Field of Search ..... 269/234, 32, 94, 269/238, 232, 229, 138, 91, 92, 93

(56) References Cited

U.S. PATENT DOCUMENTS 827,874 A * 8/1906 Lindberg ..... 269/211
2,424,090 A * 7/1947 Gordinier ..... 269/310
4,958,813 A * 9/1990 Dykstra ..... 269/32

FOREIGN PATENT DOCUMENTS

SU 0766818 * 10/1980 ..... 269/234

* cited by examiner

*Primary Examiner*—Joseph J. Hail, III
*Assistant Examiner*—Daniel Shanley
(74) *Attorney, Agent, or Firm*—Stout, Uxa, Buyan & Mullins, LLP

(57) ABSTRACT

An apparatus for retaining objects on surfaces includes a body, a lock pin extending from the body, and a pin extending through the body and engageable with the lock pin so that movement of the pin causes movement of the lock pin so that the apparatus is secured to the surface. The pin may be slidably moved into and out of the lock pin and thereby cause the lock pin to secure and release the apparatus from the surface. The apparatus may also include an engagement member that contacts an object and provides additional retentive forces. The apparatus provides clamping forces on the object so that the object may be forged or otherwise machined. Related methods are also disclosed.

19 Claims, 5 Drawing Sheets

FIG. 15
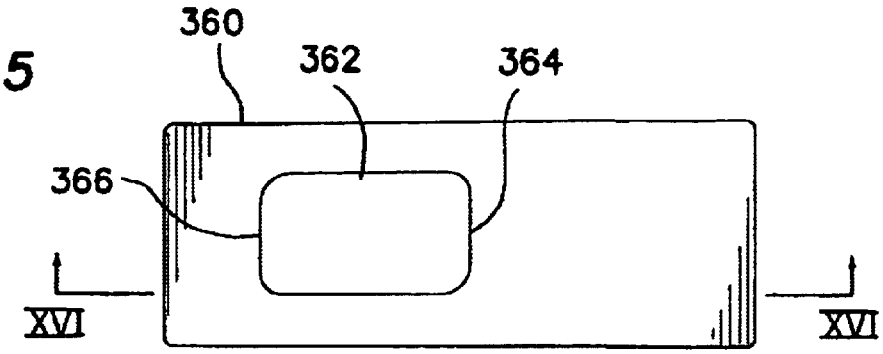
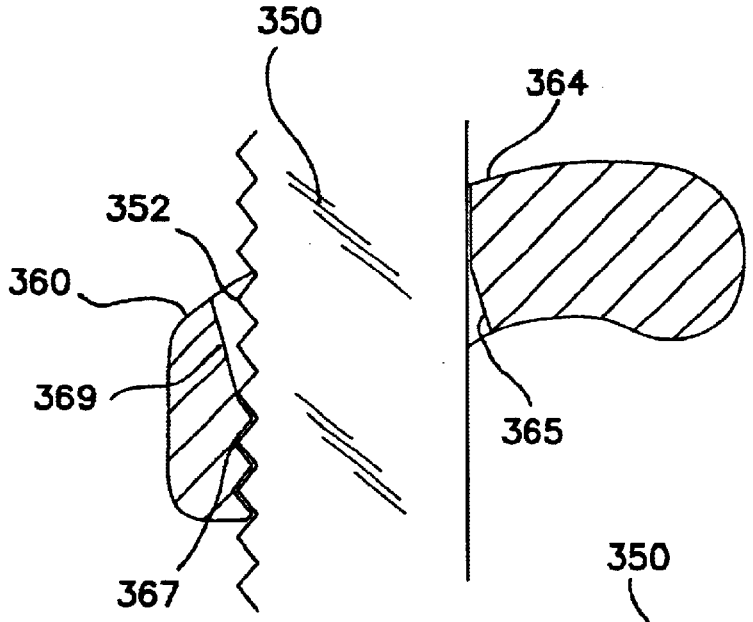
FIG. 16A
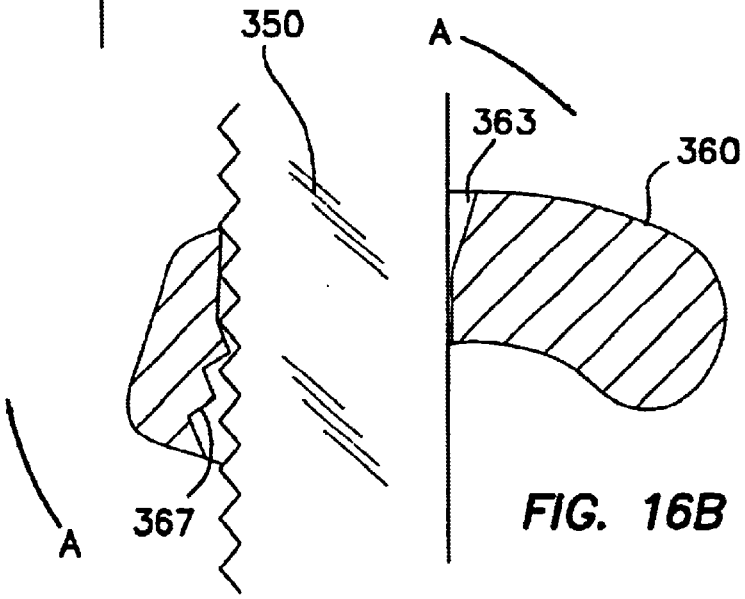
FIG. 16B

APPARATUS FOR RETAINING OBJECTS ON A SURFACE AND RELATED METHODS

BACKGROUND OF THE INVENTION

The present invention relates to tooling devices and, more particularly, to apparatus and methods for retaining objects on a surface.

In machining, and in particular metal forging, it is desirable to fix an object to be machined to a base plate so that a machine may act on the object without moving the object. For example, in forging presses or milling stations, a base plate may be provided to allow a block of material, such as a block of metal, to be secured to the base plate so that the machine may act on the block without risk that the block will unintentionally be dislodged from the base plate. This securing is especially important in fields requiring highly precise mechanical components, such as the aerospace industry. This type of securing is also important to prevent accidental movement of the block that might injure operators of such machines.

In machine tools, such as forging presses, a base plate is provided to hold the object being machined. The base plate may have one or more T-slots extending along the surface of the base plate. The T-slots permit slidable insertion of a threaded bolt having a head. The body of the bolt extends through a portion of the object, and a nut is threadedly tightened onto the bolt. Tightening the nut and bolt causes the object to which the bolt is engaged to be secured to the surface of the base plate. Conventionally, the nut and bolt are tightened using a wrench that can rotate either the nut or the bolt so that the bolt head abuts the narrow channel of the T-slot and brings the engaged object into a secure position with respect to the surface.

Examples of various devices for retaining objects to surfaces are disclosed in U.S. Pat. Nos. 2,707,419; 3,687,443; 3,935,679; 3,936,983; 3,942,780; 4,170,345; 4,181,296; 4,477,064; 4,819,922; 4,850,255; 5,255,901; 5,535,995; 5,732,937; 5,961,107; 6,035,505; 6,039,312; 6,070,334; and 6,105,949.

The foregoing devices all may suffer from the problem that they may involve an excessive number of components, and may be relatively complicated and difficult to use. In particular, the conventional nut and bolt procedure mentioned above can take a significant amount of time, and can waste resources. Because forging metals requires high temperatures, the nuts and bolts, as well as the other components of such clamping devices, are similarly exposed to high temperatures. The high temperatures and the repeated tightening of the bolts may cause them to fatigue and/or break repeatedly.

Accordingly, there remains an unmet need for a device that may be reliably secured to a surface and that is simple and easy to use. Such a device should be useful in securely retaining objects to the surface. In forging applications, the device should withstand the extremely high temperatures, and thus should not be prone to problems that may be associated with conventional devices.

SUMMARY OF THE INVENTION

The present invention provides an apparatus and methods for retaining objects to a surface. The apparatus generally comprises a body, a lock pin, and a slide pin. The slide pin and lock pin interact so that movement of the slide pin results in movement of the lock pin so that the lock pin can secure the body to a surface. The apparatus is used as a clamp to hold an object on the surface. The apparatus may clamp the object by engaging a portion, such as a lip, extending from the object, or may clamp the object by engaging a groove of the object, or may clamp the object by pressing the object against a rigid surface, or may clamp the object by pressing the object against another clamp.

In one embodiment, an apparatus for retaining a workpiece on a surface having at least one slot comprises a clamp body having a bottom face that can be positioned on the surface; a lock pin extending from the bottom face of the body; and at least one pin extending through the clamp body and operably engaged with the lock pin so that movement of the at least one pin causes movement of the lock pin so that the lock pin lockingly engages the clamp body with the surface. The pins of the foregoing apparatus may be slidably engageable to cause the lock pin to be pulled within the surface thus fixing the apparatus to the surface. The pin may extend through a hole in the lock pin and through the clamp body An apparatus for retaining a workpiece on a surface having at least one slot may also comprise a clamp body having a bottom face positionable on the surface; a lock pin extending from the clamp body, the lock pin having an end that engages with a slot of the surface; and at least one slide pin projecting through the clamp body and the lock pin.

The foregoing apparatuses may also comprise an engagement member for engaging the workpiece. The engagement member may be provided on the front surface of the clamp body, and may include one or more pins disposed therethrough and extending into the clamp body. Displacement of the pins may cause a displacement of the engagement member so that the engagement member provides additional retentive forces on the workpiece. The lock pin of the foregoing apparatuses may have a head engageable with a T-slot provided on the surface, and in one embodiment, it may be T-shaped. The slide pin of the foregoing apparatuses may also have an angled longitudinal surface so that the width of the slide pin changes and the slide pin may swedgingly engage the lock pin.

An impact clamp assembly for retaining a workpiece on a surface having at least one slot may comprise a clamp body positionable on the surface; a lock pin extending from the clamp body and slidably disposed therein; at least one slide pin projecting through the clamp body and the lock pin; and means for engaging the workpiece so that the workpiece is retained on the surface.

The means for engaging the workpiece of the foregoing assembly may comprise an engagement member positioned at the front surface of the clamp body, and may also comprise a plurality of slide pins extending through the engagement member into the clamp body, or the means for engaging the workpiece may comprise a support extending from the clamp body and away from the surface to which the clamp body is attached, and a brace on the support that is engageable with the workpiece. The foregoing assembly may also comprise a second clamp body having a lock pin extending therethrough and at least one slide pin extending through the clamp body and the lock pin. The two clamp bodies may act as a vise secured to the surface and to opposite sides of the workpiece.

The components of the foregoing devices may be made from heat-resistant steel.

A method for attaching an impact clamp to a surface having at least one slot, comprises the steps of: (a) providing an impact clamp having a lock pin extending from a clamp body and having an end engageable with the slot of the surface, and at least one slide pin extending through the body and the lock pin, the slide pin having an angled longitudinal surface permitting a swedged engagement of the slide pin with the lock pin; (b) positioning the impact clamp on the surface by aligning the lock pin with a slot; and (c) urging the slide pin into the lock pin and body so that the slide pin swedgingly engages with the lock pin causing the lock pin to clamp the surface between the body and the end of the lock pin.

The foregoing method may also include the step of engaging an engagement member of the impact clamp with a workpiece so that the workpiece is retained to the surface. The workpiece may be fixed to the surface by clamping the workpiece between the impact clamp and the surface, or may be wedged between the impact clamp and another surface, including another impact clamp.

Any feature or combination of features described herein are included within the scope of the present invention provided that the features included in any such combination are not mutually inconsistent as will be apparent from the context, this specification, and the knowledge of one of ordinary skill in the art.

Additional advantages and aspects of the present invention are apparent in the following detailed description and claims.

BRIEF DESCRIPTION OF THE DRAWINGS

FIG. 15 is a top plan view of the support and brace shown in FIG. 13A and FIG. 14A.

FIG. 16A is a sectional view of the support and brace along line XVI—XVI of FIG. 15.

FIG. 16B is the same view as FIG. 16A except the brace has been rotated to the right as indicated by the arrows.

DETAILED DESCRIPTION OF THE PRESENTLY PREFERRED EMBODIMENTS

Although the presently preferred embodiment of the invention is designed to be used with machining tools, including, but not limited to, forging presses and milling stations, and in particular is designed to secure an object being forged, cut, bored, shaped, or otherwise machined, to the surface or bed of the machine tool, the invention may be used in any similar situation where it is desired to fix an object, at least temporarily, to a surface.

The apparatus herein described seeks to solve the problem of conventional devices in that it is a single unit with few components. The components are able to withstand high temperatures when used in forging applications, and do not fatigue or wear out easily. The apparatus of the invention accordingly may substantially reduce the time needed to secure and release objects to or from a surface, and may reduce the costs associated with fixing objects to surfaces.

Figure 1:
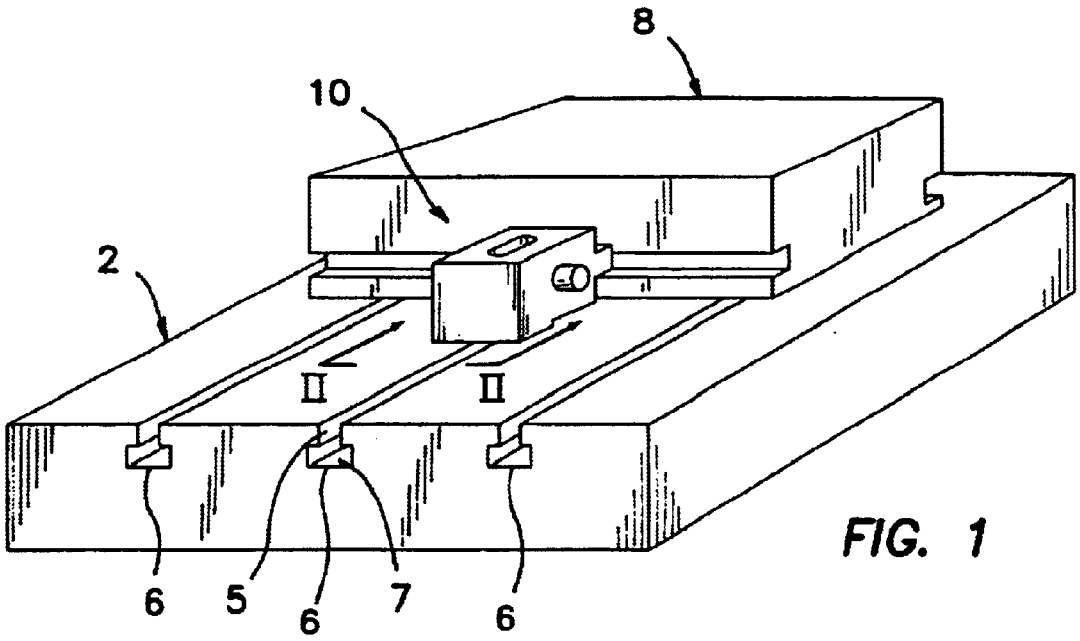
FIG. 1 is a perspective view of one embodiment of the apparatus of the invention on a base plate engaging an object.

Referring to the figures, and in particular, FIG. 1, an apparatus 10 for retaining a workpiece 8 on a base plate 2 is illustrated. Apparatus 10 retains, or otherwise immobilizes, workpiece 8 to base plate 2 by acting as a stop on base plate 2. In other words, apparatus 10 may be fixedly secured to base plate 2, thereby permitting workpiece 8 to be positioned against apparatus 10. Accordingly, and as described herein, apparatus 10 may act to clamp workpiece 8 to base plate 2. Thus, apparatus 10 is also referred to herein as an impact clamp.

Base plate 2 is illustrated having a plurality of grooves or tracks extending along its length. As illustrated in FIG. 1, the tracks of base plate 2 are preferably T-slots 6. T-slots are characterized in that they have a relatively narrow channel 5 at a surface of the base plate, and a relatively wider channel 7 within the base plate. The two channels are arranged perpendicularly to each other, thereby forming a "T". In reference to the particular disclosure herein, base plate 2 may be a bed of a forging press, however, base plate 2 should not be limited to forging presses. In addition, although the apparatus of the invention is shown engaged with a T-slot, the apparatus may be used with other similarly configured slots, such as slots having a narrower portion at a surface, and a wider portion away from the surface. One such example includes L-shaped slots and Y-shaped slots.

Workpiece 8, as used herein, may also be referred to as a die. Typically, workpiece 8 is a metal object that is being machined, for example, forged, bored, or otherwise shaped. However, workpiece 8 may also be a wood or plastic object depending on the nature of the product employing the workpiece.

Impact clamp 10 generally comprises a body 20 (e.g., a clamp body), a post or lock pin 40, and a slide pin 30. The details of one embodiment of impact clamp 10 are illustrated in FIG. 2, which is viewed along line II—II of FIG. 1.

Clamp body 20, as illustrated, has a generally cubical structure. For example, and by way of convenient reference, clamp body 20 has a top surface 26A, a bottom surface 26B, side surfaces 26C and 26D, a rear surface 26E, and a front surface 26F. In reference to the disclosure herein, front surface 26F is the surface of the clamp body that is closest to, or in contact with, workpiece 8. Similarly, bottom surface 26B is the surface of the clamp body that is closest to, or in contact with, the surface of base plate 2. As will be understood from the disclosure herein, the specific orientation (e.g., front, rear, top, bottom, up, down, left, or right) is only being made with reference to the drawings herein. As the specific orientation of the base plate changes, the various orientations of the other components may change accordingly. In addition, although certain shapes of the impact clamp are illustrated and described herein, the specific shapes are not to be construed as delimiting of the invention, and that any shape may be provided depending on the particular application of the impact clamp.

Figure 2:
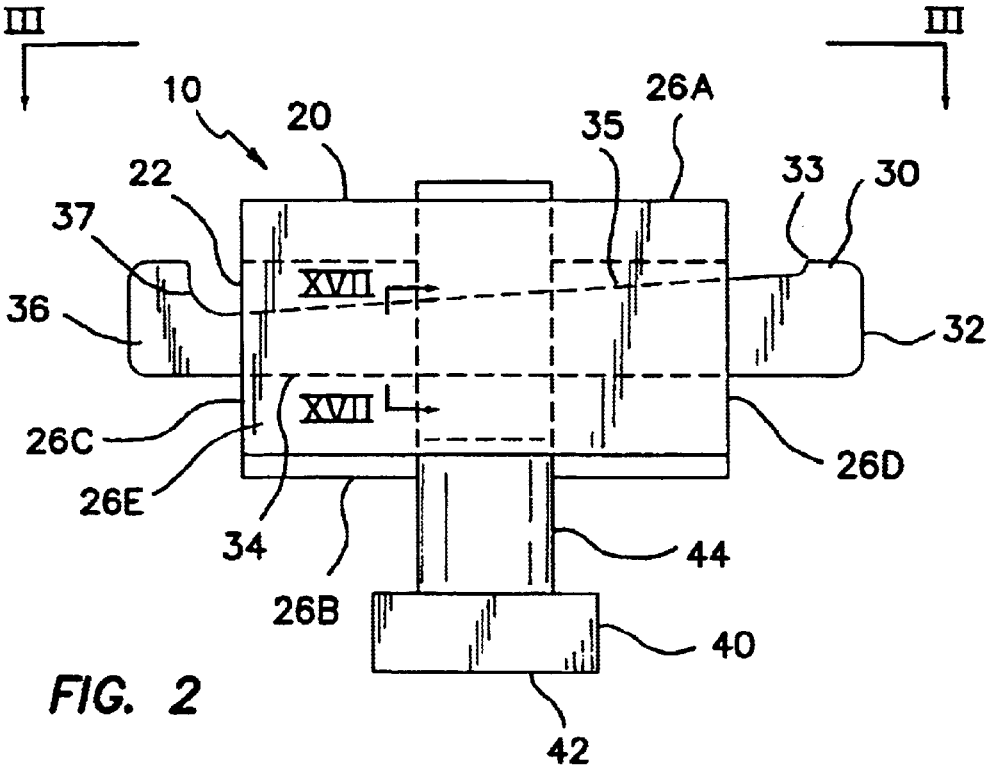
FIG. 2 is a rear plan view of the apparatus of the invention along line II—II of FIG. 1

As shown in FIG. 2, clamp body 20 has a hole 22 (i.e., a slide pin hole) extending through the body. Hole 22 is shown extending from side 26C to 26D. In certain embodiments of the invention, the longitudinal axis of hole 22 extends parallel to front surface 26F. Clamp body 20 also includes a lock pin hole 24 extending through the body. Lock pin hole 24 is shown extending from side 26A to 26B (see FIGS. 3 and 4, described infra). Lock pin hole 24 may be approximately perpendicularly oriented with respect to slide pin hole 22.

As depicted in FIG. 2, slide pin 30 is a pin having a length. The length of slide pin 30 is preferably longer than slide pin hole 22, discussed above, so that at any given time, at least one end of slide pin 30 is extending from slide pin hole 22. Slide pin 30 is characterized by a head portion 32 (i.e., slide pin head), and a foot portion 36 (i.e., a slide pin foot) at the opposite end of the slide pin head. Slide pin body 34 is disposed between slide pin head 32 and slide pin foot 36. In the illustrated embodiment, slide pin 30 is a single piece of material, and accordingly, the components of the slide pin, namely, slide pin head 32, slide pin body 34, and slide pin foot 36, are all one piece of material. As shown in FIG. 2, slide pin body 34 has a length with an angled surface 35 along the length of the body. Angled surface 35 of slide pin 30 of FIG. 2 is at an angle of approximately 3 degrees from the bottom of slide pin body 34. However, as will be understood by persons skilled in the art, the particular angle is not to be construed as limiting of the invention, and that any angle may be used depending on the specific dimensions of the components of the impact clamp and the intended use.

As discussed herein, slide pin head 32 is configured to be the end of the slide pin that is pressed or otherwise urged into the lock pin and clamp body to engage the slide pin with the lock pin, and slide pin foot 34 is the end of the slide pin that is pressed or otherwise urged into the lock pin and clamp body to disengage the slide pin from the lock pin. In addition, slide pin head and slide pin foot also include a lip portion 33 and 37, respectively, that help retain slide pin 30 in the clamp body. As will be understood from the disclosure herein, when the slide pin foot 36 is urged into the clamp body, for example, by hitting the slide pin foot with a hammer, lip portion 37 helps prevent slide pin 30 from moving out of the clamp body by engaging with the side wall of the clamp body.

Figure 17:
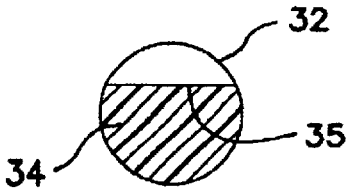
FIG. 17 is a sectional view of a slide pin of the apparatus of the invention along line XVII—XVII of FIG. 2.

FIG. 17 depicts the cross-sectional view of slide pin 30 along line XVII—XVII of FIG. 2. As illustrated, slide pin 30 may be generally circular in cross-section. In the illustrated embodiment, angled surface 35 is relatively flat when viewed in cross-section. In addition, slide pin head 32, as seen in FIG. 17, and slide pin foot 36 (not shown) are generally circular in cross-section. However, as will be apparent from the disclosure herein, other cross-sectional shapes may be used without departing from the spirit of the invention. For example, the cross-section of slide pin body 34 may be circular, and the body may still have an angled surface from one end to another.

Referring again to FIG. 2, lock pin 40 is illustrated upwardly extending through clamp body 20. Lock pin 40 has a head portion 42 (i.e., lock pin head), and a body portion 44 (i.e., lock pin body). Lock pin 40 is structured to fit within lock pin hole 24 (FIG. 3) and to extend from clamp body 20. Lock pin 40 is intended to be inserted into T-slot 6 of base plate 2. In particular, lock pin head 42 will be inserted into relatively wide channel 7 of T-slot 6, and lock pin body 44 will correspondingly be inserted into relatively narrow channel 5 of T-slot 6.

Thus, when the impact clamp is assembled, impact clamp 10 may move along T-slot 6 as shown in FIG. 1, but will be generally fixed to the surface of base plate 2 when lock pin 40 is tightened. As will be apparent from the disclosure herein, before lock pin 40 is engaged with slide pin 30, impact clamp 10 is loosely positioned within T-slot 6. In other words, impact clamp 10 may be slidably positioned along the base plate, and may have limited orthogonal movement with respect to the surface of the base plate (e.g., impact clamp 10 cannot be substantially removed away from the surface of the base plate). The amount of orthogonal movement is determined by the physical relationship between the depth of the narrow channel of the T-slot and the length of the lock pin body, in particular, the distance between the lock pin head and a hole extending through the lock pin body, described infra. However, once slide pin 30 is engaged with lock pin 40 by urging slide pin 30 into lock pin 40 and clamp is body 20 so that the relatively thicker portion of slide pin body 34 engages with a hole in lock pin body 44, lock pin 40 will be urged into clamp body 20 (upwardly, as shown in FIGS. 1 and 2) so that lock pin head 42 will be in abutting relationship with the sidewalls of narrow channel 5 of T-slot 6. When slide pin 30 sufficiently engages with lock pin 40, the impact clamp will be fixedly secured at a position along T-slot 6 of base plate 2. When the engagement is strong, the impact clamp will not be movable without first disengaging slide pin 30 from lock pin 40. The disengagement of slide pin 30 and lock pin 40 can be performed by urging the slide pin in the opposite direction from the direction in which it was inserted.

Figure 3:
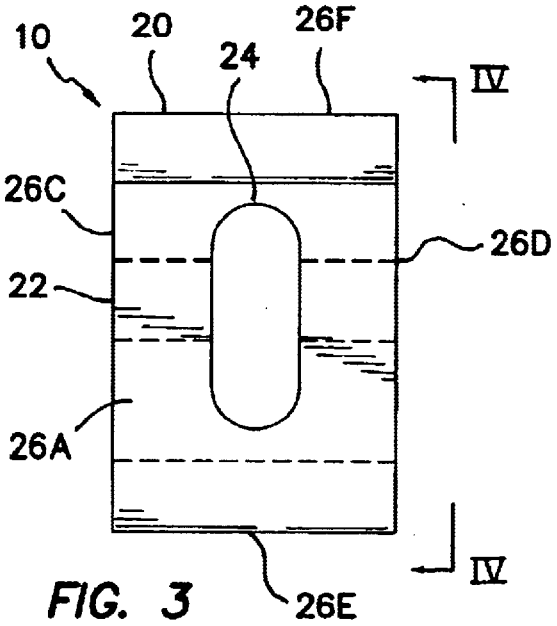
FIG. 3 is a top plan view of the apparatus of the invention along line III—III of FIG. 2.

FIG. 3 illustrates the top view of impact clamp 10 along line III—III of FIG. 2. FIG. 3 more clearly illustrates the orientations of slide pin hole 22 and lock pin hole 24. In particular, slide pin hole 22 is shown being at an approximately 90 degree angle with respect to the longitudinal axis of lock pin hole 24. In addition, FIG. 3 shows that lock pin hole 24 is relatively oblong. In particular, the illustrated embodiment depicts lock pin hole 24 as two roughly semicircular ends with a relatively straight portion between the two ends.

Figure 4:
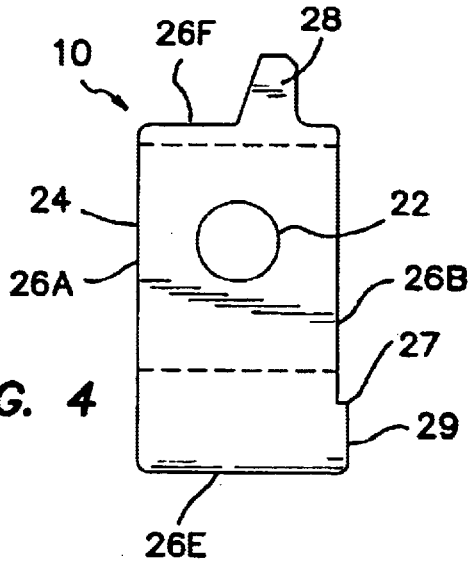
FIG. 4 is a side plan view of the apparatus of the invention along line IV—IV of FIG. 3.

FIG. 4 depicts the side view of impact clamp 10 along line IV—IV of FIG. 3. As can be seen, slide pin hole 22 is generally circularly oriented and is laterally positioned to extend through the relatively linear portion of lock pin hole 24. In the illustrated embodiment of the impact clamp, front surface 26F includes a nose 28 extending therefrom. As illustrated in FIG. 1, nose 28 may facilitate engagement with a groove of working piece 8, and thereby reduce, or even prevent, movement of working piece 8 away from the surface of base plate 2. Accordingly, nose 28 is an engagement member used to engage with the working piece 8. In other embodiments of the invention, as disclosed herein, nose 28 may be omitted from front surface 26F such that front surface 26F is a relatively planar surface. FIG. 4 also clearly depicts a foot portion 29 extending from bottom surface 26B. Foot portion 29 provides a fulcrum 27 about which the front of impact clamp 10 may pivot away from and towards the surface of a base plate depending on the degree of engagement of slide pin 30 with lock pin 40.

Figure 5:
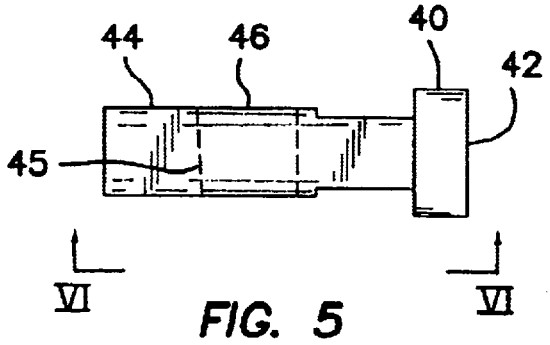
FIG. 5 is a rear plan view of a lock pin used with the apparatus of the invention.
Figure 7:
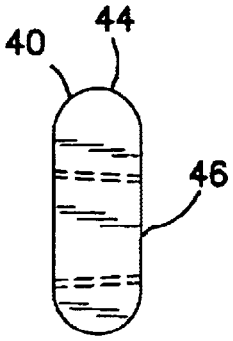
FIG. 7 is a top plan view of the lock pin of FIG. 6 along line VII—VII.
Figure 6:
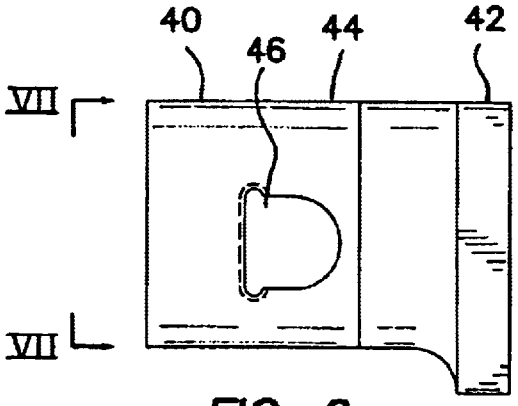
FIG. 6 is a side plan view of the lock pin of FIG. 5 along line VI—VI.

FIG. 5 shows a locking pin 40 along the same view as FIG. 2 except that the locking pin has been rotated 90 degrees counterclockwise. The locking pin of FIG. 5 differs slightly from that of FIG. 2 by the inclusion of a narrowed portion of locking pin body 44 near locking pin head 42. Otherwise, the two locking pins are identical. As shown in FIG. 5, locking pin 40 includes a slide pin hole 46 extending through lock pin body 44. Slide pin hole 46 is positioned to be aligned with slide pin hole 22 of clamp body 20, discussed above. Thus, slide pin hole 22 and slide pin hole 46 define a single slide pin hole when the impact clamp is assembled. Slide pin hole 46 includes a surface that is generally parallel to the bottom of clamp body 20, and an angled surface 45. The opening of slide pin hole 46 is slightly larger than the cross-sectional size of the narrower portion of slide pin body 34. Thus, as slide pin 30 is urged into slide pin hole 46 when the impact clamp is assembled, the thickened portion of angled surface 35 of the slide pin engages with angled surface 45 of the slide pin hole and causes the slide pin to move (vertically, as shown in FIG. 2) into the impact clamp body. FIG. 6 depicts the side view of slide pin 40 along line VI—VI of FIG. 5. As shown, the cross-section of slide pin hole 46 is shaped to matingly receive slide pin 30. The top view of slide pin 40 is illustrated in FIG. 7 along line VII—VII of FIG. 6.

Figure 8:
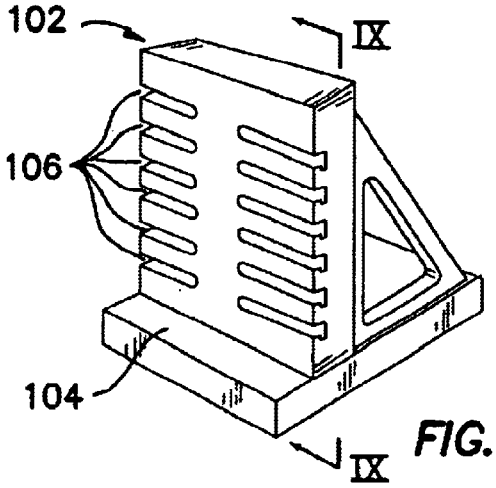
FIG. 8 is a perspective view of a base plate that can be used with the apparatus of the invention.

FIG. 8 illustrates a base plate 102 similar to base plate 2 of FIG. 1 in that base plate 102 includes a plurality of L-slots 106 at the surface of the base plate. However, base plate 102 differs from base plate 2 in that the plate is configured to be oriented generally vertically. A working piece, such as a die, would be positioned against base plate 102 and surface 104. Accordingly, L-slots 106 provide a plurality of fixed positions for one or more impact clamps to be secured. For example, one impact clamp could be placed in each of the columns of L-slots 106, and thus, two impact clamps would act to retain the die to the base plate.

Figure 9:
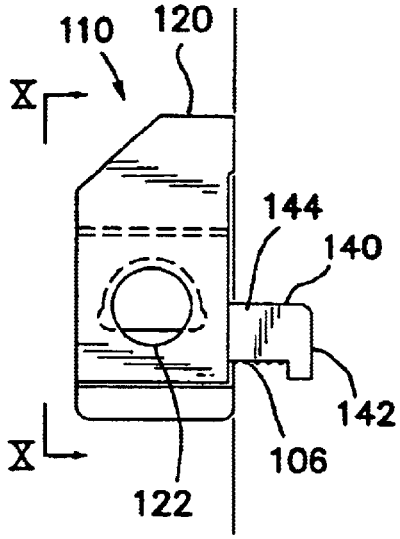
FIG. 9 is a side plan view of another embodiment of the apparatus of the invention engaged with the base plate of FIG. 8 taken along IX—IX.
Figure 10:
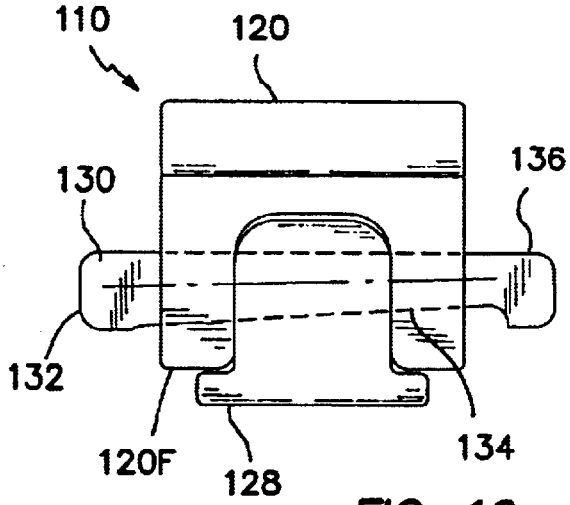
FIG. 10 is a front plan view of the apparatus of FIG. 9 along line X—X.

An example of an impact clamp 110 to be used with base plate 102 is illustrated in FIG. 9 along line IX—IX of FIG. 8. Locking pin 140 is illustrated within L-slot 106 with locking pin head 142 abutting the narrow channel of the L-slot. Slide pin hole 122 is illustrated with a slide pin extending therethrough (see FIG. 10). As shown, impact clamp 110 will thus provide a clamping mechanism to retain a die against a vertical surface. In this manner, impact clamp 110 can be used as a clamp on an object by holding the object against a horizontal surface, such as surface 104 of FIG. 8. The view of impact clamp 110 along line X—X is shown in FIG. 10. In addition, FIG. 10 shows locking pin 140 as an engagement member 128 extending through clamp body 120, and beyond front surface 126F. Engagement member 128 will be urged forward against the surface of an object when slide pin 130 is urged into locking pin 140. Similar to the impact clamp of FIG. 2, and in accordance with the spirit of the invention, impact clamp 110 comprises a clamp body 120, a locking pin 140 extending from the body, and a slide pin 130 extending through the body and the locking pin.

Figure 12:
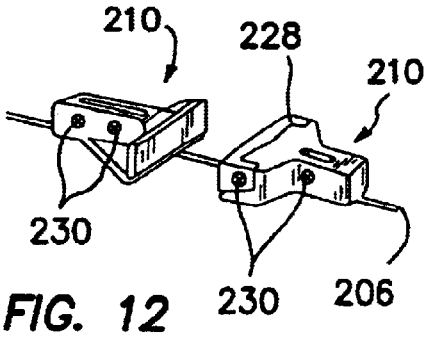
FIG. 12 is a perspective view of two embodiments of the apparatus of the invention engaged with a T-slot of a base plate. The apparatus on the right is the same as the apparatus of FIG. 11.
Figure 11:
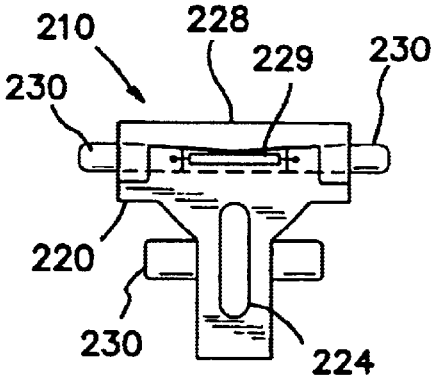
FIG. 11 is a top plan view of another embodiment of the apparatus of the invention.

Another specific example of an impact clamp that comprises a clamp body, a locking pin extending from the body, and at least one slide pin extending through the body and through the locking pin is illustrated in FIGS. 11 and 12. In particular, impact clamp 210 may comprise a plurality of slide pins 230 and a locking pin (not shown). The locking pin of impact clamp 210 is structured to be slidably positioned within T-slot 206, similar to that described supra. As specifically illustrated in FIG. 12, utilizing two impact clamps with front surfaces facing each other, a die, or other suitable object, can be wedged between the two impact clamps, so that the die is immobilized.

Impact clamp 210 also illustrates a nose, or engagement member, 228 that will abut against the die being machined thereby retaining the workpiece to the surface. Engagement member 228 fits over the front surface of impact clamp body 220. Two slide pins 230 are illustrated extending through engagement member 228 and the front surface of clamp body 220. As shown in FIG. 11, when the slide pins are urged into the body, the slide pins will cause the engagement member to forwardly extend from the body. Because the impact clamp would already be positioned against the die and secured to the base plate, the extension of the engagement member from the clamp body provides additional retention capability of the device. Slide pins 230 that extend through engagement member 228 are also attached to one or more springs 229, or other similar devices. The spring enables the slide pins to naturally extend from the clamp body. The spring preferably provides less force than the force of engagement between slide pins 230 and engagement member 228. However, when the slide pin is disengaged from the locking pin, and the impact clamp is withdrawn from the die, the spring causes the slide pins to be urged out of the clamp body.

Figure 13A:
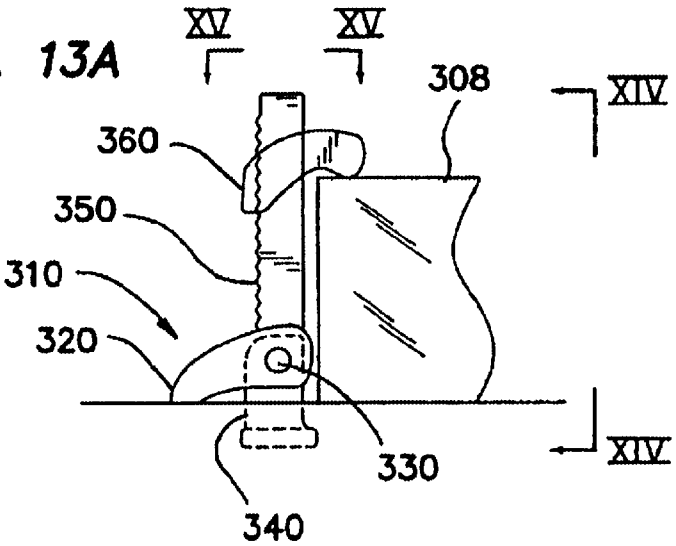
FIG. 13A is a side plan view of another embodiment of the apparatus of the invention in use with a support and a brace.
Figure 13B:
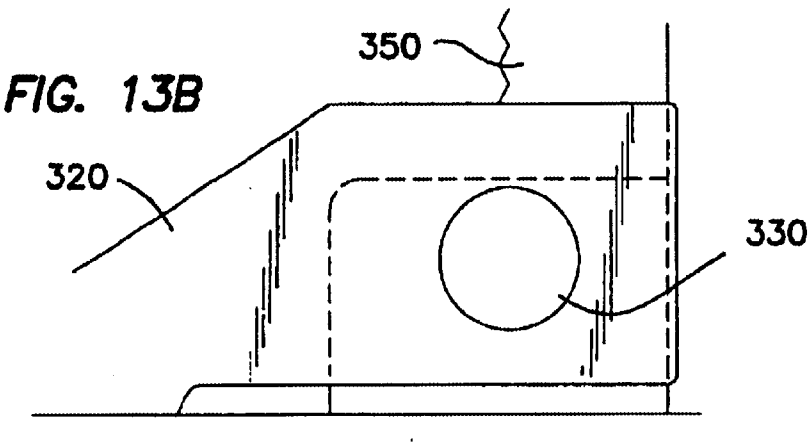
FIG. 13B is a magnified side plan view of the apparatus of the invention shown in FIG. 13A.

An additional example of an impact clamp that comprises a clamp body, a locking pin extending from the body, and a slide pin extending through the body and the locking pin is illustrated in FIGS. 13–14. In that regard, FIG. 13A depicts an impact claim 310 having a clamp body 320, a locking pin 340 extending from the clamp body, and a slide pin 330 extending through the body and the locking pin. A magnified view of the lower portion of FIG. 13A is illustrated in FIG. 13B. Impact clamp 310 is designed to be used in conjunction with a support 350. Support 350 may be characterized as a generally rectangularly cross-sectioned upright having a length orthogonally extending from a surface of a base plate. In one embodiment, support 350 includes teeth, or cogs, 352 (FIG. 16A) along at least one side of the support. The clamping system illustrated in FIGS. 13–14 may also include a brace 360 that is able to be positioned at various lengths along support 350. As shown in FIG. 13A, impact clamp 310 and brace 360 are intended to cooperatively interact to retain a die 308 to a base plate, as discussed infra.

Figure 14A:
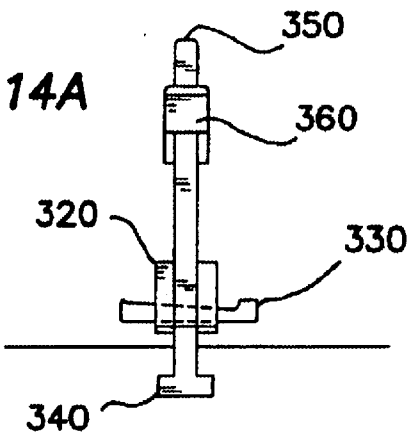
FIG. 14A is a front plan view of the apparatus shown in FIG. 13A along line XIV—XIV.
Figure 14B:
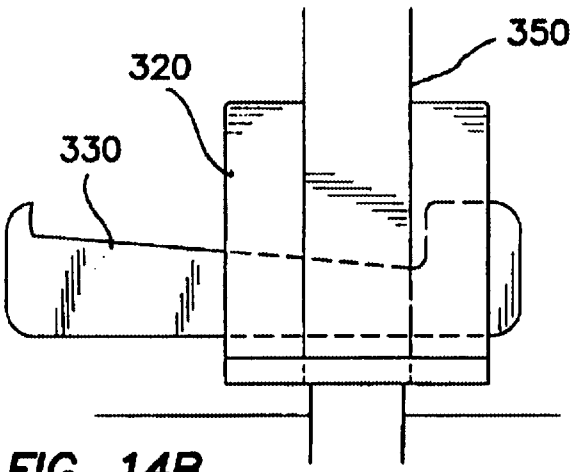
FIG. 14B is a magnified front plan view of the apparatus shown in FIG. 14A.

The view along line XIV—XIV of FIG. 13A is shown in FIG. 14A. A magnified view of the lower portion of FIG. 14A is shown in FIG. 14B. Slide pin 330 is shown at least partially engaged with locking pin 340 in FIG. 14A, and disengaged in FIG. 14B.

The view of brace 360 and support 350 along line XV—XV is illustrated in FIG. 15. As can be seen in FIG. 15, brace 360 has a generally rectangular shape. Brace 360 includes an approximately centrally disposed opening 362 having a front surface 364 and a rear surface 366. As discussed above, the terms "front" and "rear" are relative, and in reference to the disclosure herein, "front" refers to the relative position closest an object that is being machined or otherwise worked on. The action of brace 360 is more clearly illustrated in FIGS. 16A and 16B viewed along line XVI—XVI of FIG. 15. In general, brace 360 is structured to pivot about support 350. In the illustrated embodiment, the front surface 364 and the rear surface 366 have a plurality of sub portions. In the specifically illustrated embodiment, the front surface has two sub portions 363 and 365, and the rear surface has two sub portions 367 and 369. As illustrated, front sub portion 363 is generally parallel to rear sub portion 367, and front sub portion 365 is generally parallel to rear sub portion 369. Each of the front sub portions join at an angle, and each of the rear portions join at an angle. Brace 360 pivots about the vertices of those angles. Both front sub portions 363 and 365 are relatively smooth, and rear portion 369 is relatively smooth. Rear portion 367 has a plurality of cogs configured to engage with cogs 352 of support 350.

As shown by the arrows A of FIG. 16B, when support 350 moves downwardly (as illustrated), cogs 352 act on the cogs of brace 360. The downward force causes the brace to pivot clockwise (arrows A) so that rear sub portion 367 disengages from cogs 352, and rear sub portion 369 engages with the surface of cogs 352. Similarly, the downward force causes front sub portion 363 to disengage from the front surface of support 350, and front sub portion 365 to engage with the front of the support. The downward movement of support 350 may be caused by the swedging engagement of slide pin 330 with lock pin 340. Thus, slide pin 330 will cause lock pin 340 to be pulled against a T-slot, and will cause support 350 to be pulled down slightly. The cooperative engagement of impact clamp 310 and brace 360 will thereby retain a die to a surface. In addition, the actions of impact clamp 310 provide relatively fine adjustments in securing a die to a surface. For example, brace 350 may be positioned along support 360 so that the lower front end of the brace contacts the object. The cogs 352 may provide the initial clamping force of brace 360. The tightening of the lock pin 340 and the corresponding pivoting of the clamp body about the fulcrum of the foot of the body will cause support 350 to be slightly pulled down because cogs 352 of support 350 are engaged with the cogs of brace 360, the brace will rotate with additional force to hold the die.

Figure 18:
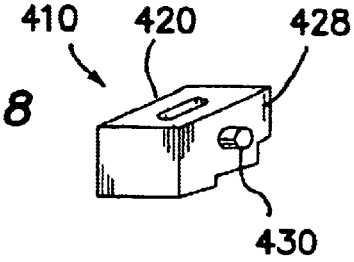
FIG. 18 is a perspective view of the apparatus of the invention similar to that shown in FIG. 1, except a different configuration of an engagement member is shown.

FIG. 18 illustrates another impact clamp 410 comprising a clamp body 420, a slide pin 430, and a locking pin (not shown). In this embodiment, engagement member 428 is seen extending almost the entire height of the front surface of the clamp body.

The impact clamp described herein may be used by sliding the head of the locking pin into a T-slot of a base plate. The impact clamp may then be slid along the channel of the T-slot, or otherwise positioned, to abut an object being machined. At the desired location, the impact clamp can be secured to the base plate by urging the slide pin into the body. In the embodiment described supra, the slide pin is hit, for example by a hammer, to rapidly force the slide pin into the clamp body. The force exerted by hitting the slide pin will cause the pin to sufficiently pull on the lock pin so that the lock pin head engages with the T-slot. When the impact clamp is to be loosened, and otherwise repositioned or removed, the slide pin foot (i.e., the opposite end of the slide pin) may be hit, for example by a hammer, to disengage the slide pin from the clamp body and lock pin. The impact clamp may then be slid along the T-slot. In addition, a slide pin extension may be provided. The extension may be positioned against the end of the slide pin that is to be hit, and the hammer can then hit the extension.

The impact clamp of the invention may be made of any suitably strong material that is useful for retaining objects on surfaces, for example, the impact clamp may be manufactured from metals, woods, or plastics, provided that the material is sufficiently strong to hold the objects without being broken. In an embodiment of the invention used for forging applications, the components of the impact clamp are made of steel, preferably high quality steel, for example, Fink1 FXT2 steel, or Inconel steel (A. Finkl & Sons, Southgate, Calif.). The components are forged into the desired configurations using methods well known in the art. Because the components of a forging impact clamp will be exposed to extremely high temperatures and forces, it is desirable that the steel of the components of the impact clamp be made of a material that is able to withstand the temperatures and forces used in forging processes.

Although the embodiments described supra, other embodiments may be provided without departing from the spirit of the invention.

For example, although the illustrated slide pin is relatively smooth on its surface, thereby permitting the slidable engagement with lock pin 40, described herein, slide pin 30 may also be threaded or include one or more rings of teeth or cogs. Such an embodiment may be useful in applications other than forging applications. In such embodiments, lock pin 40 will accordingly include mating components to achieve the desired cooperative movement between the slide pin and the lock pin. For example, if slide pin 30 included one or more gears around its body, and lock pin 40 included a mating gear, rotation of slide pin could cause a corresponding linear movement of the lock pin.

In addition, although the illustrated embodiment utilizes a single slide pin extending through the lock pin, alternative embodiments could utilize two or more slide pins. Lock pin may also be provided in alternative configurations including relatively cylindrical cross-sections. As will be understood by those skilled in the art, the slide pin hole extending through the lock pin would similarly have to be configured so that the lock pin is not weakened by the hole.

While this invention has been described with respect to various specific examples and embodiments, it is to be understood that the invention is not limited thereto and that it can be variously practiced with the scope of the following claims.

What is claimed is:

1. An apparatus for retaining a workpiece on a surface having at least one slot, the apparatus comprising:

a clamp body having a bottom face positionable on the surface;

a lock pin extending from the bottom face of the body; and at least one pin extending through the clamp body and operably engaged with the lock pin so that movement of the at least one pin causes movement of the lock pin so that the lock pin lockingly engages the clamp body with the surface.

2. The apparatus of claim 1, wherein the at least one pin is slidably engaged with the lock pin.

3. The apparatus of claim 1, wherein the clamp body, the lock pin, and the at least one pin are manufactured from steel resistant to high temperatures.

4. The apparatus of claim 1, wherein the at least one pin extends through a hole in the lock pin and through the clamp body.

5. The apparatus of claim 1, wherein the lock pin is T-shaped and has an end to be retained within the slot of the surface.

6. The apparatus of claim 1, comprising an engagement member positioned on the front of the clamp body, the engagement member engageable with the workpiece.

7. The apparatus of claim 6, comprising a plurality of pins extending through the engagement member and into the clamp body, displacement of the pins into the body causing forward displacement of the engagement member.

8. An apparatus for retaining a workpiece on a surface having at least one slot, the apparatus comprising:

a clamp body having a bottom face positionable on the surface;

a lock pin extending from the clamp body, the lock pin having an end that engages with a slot of the surface; and at least one slide pin projecting through the clamp body and the lock pin.

9. The apparatus of claim 8, wherein the clamp body, the lock pin, and the at least one slide pin are manufactured from heat resistant steel.

10. The apparatus of claim 8, comprising an engagement member on a front face of the clamp body, the engagement member engageable with the workpiece.

11. The apparatus of claim 10, comprising a plurality of slide pins projecting through the engagement member into the clamp body.

12. The apparatus of claim 8, wherein the at least one slide pin has an angled longitudinal surface along its length for swedgingly engaging the lock pin.

13. The apparatus of claim 8, wherein the lock pin comprises a head engageable with a T-slot.

14. An impact clamp assembly for retaining a workpiece on a surface having at least one slot comprising:

a clamp body positionable on the surface;

a lock pin extending from the clamp body and slidably disposed therein, the lock pin having an end that engages with a slot of the surface;

at least one slide pin projecting through the clamp body and the lock pin; and means for engaging the workpiece so that the workpiece is retained on the surface.

15. The assembly of claim 14, wherein the means for engaging the workpiece comprises an engagement member positioned at the front surface of the clamp body.

16. The assembly of claim 15, wherein the means for engaging the workpiece further comprises a plurality of slide pins extending through the engagement member into the clamp body, movement of the slide pins causing forward movement of the engagement member.

17. The assembly of claim 14, wherein the means for engaging the workpiece comprises a support extending from the clamp body and away from the surface to which the clamp body is attached, and a brace on the support, the brace engageable with the workpiece.

18. The assembly of claim 14, further comprising a second clamp body having a lock pin extending therethrough and at least one slide pin extending through the clamp body and the lock pin, each clamp body fixable to the surface on opposite sides of the workpiece.

19. A method for attaching an impact clamp to a surface having at least one slot, comprising the steps of:

(a) providing an impact clamp having a body positionable on the surface, a lock pin extending from the body and having an end engageable with the slot, and at least one slide pin extending through the body and the lock pin, the slide pin having an angled longitudinal surface permitting a swedged engagement of the slide pin with the lock pin;

(b) positioning the impact clamp on the surface by aligning the lock pin with a slot; and (c) urging the slide pin into the lock pin and body so that the slide pin swedgingly engages with the lock pin causing the lock pin to clamp the surface between the body and the end of the lock pin.

* * * * *